US007433171B2

(12) United States Patent
Vincent et al.

(10) Patent No.: US 7,433,171 B2
(45) Date of Patent: Oct. 7, 2008

(54) FAST CURRENT CONTROL OF INDUCTIVE LOADS

(75) Inventors: Kenneth Vincent, Alcester (GB); Peter J. Knight, Birmingham (GB)

(73) Assignee: TRW Limited (GB)

( * ) Notice: Subject to any disclaimer, the term of this patent is extended or adjusted under 35 U.S.C. 154(b) by 213 days.

(21) Appl. No.: 10/418,960

(22) Filed: Apr. 18, 2003
(Under 37 CFR 1.47)

(65) Prior Publication Data

US 2004/0057183 A1 Mar. 25, 2004

Related U.S. Application Data

(63) Continuation of application No. PCT/GB01/04640, filed on Oct. 17, 2001.

(51) Int. Cl.
*H01H 47/00* (2006.01)

(52) U.S. Cl. ..... 361/159; 361/139

(58) Field of Classification Search ..... 361/91.1, 361/111, 139, 143, 146, 152, 154, 159, 160
See application file for complete search history.

(56) References Cited

U.S. PATENT DOCUMENTS 5,012,381 A 4/1991 Elliott et al.
5,532,526 A * 7/1996 Ricco et al. ..... 307/104
5,543,632 A * 8/1996 Ashley ..... 257/48
5,550,701 A * 8/1996 Nadd et al. ..... 361/103
5,621,604 A 4/1997 Carlson
5,914,849 A * 6/1999 Perreira ..... 361/187
5,977,756 A * 11/1999 Nagata et al. ..... 323/282
6,005,763 A * 12/1999 North ..... 361/154
6,160,694 A * 12/2000 Crespi et al. ..... 361/111
6,369,533 B1 * 4/2002 Mourad et al. ..... 318/254
6,934,140 B1 * 8/2005 Rober et al. ..... 361/154

FOREIGN PATENT DOCUMENTS

| | | | |
|---|---|---|---|
| EP | 0 607 030 | | 7/1994 |
| EP | 1 045 501 | | 10/2000 |
| GB | 2269950 | * | 7/1993 |
| JP | 11308780 | | 11/1999 |

* cited by examiner

*Primary Examiner*—Michael J Sherry
*Assistant Examiner*—Danny Nguyen
(74) *Attorney, Agent, or Firm*—MacMillan, Sobanski & Todd, LLC

(57) ABSTRACT

A circuit arrangement for the fast dissipation of the stored magnetic energy in an inductive load controlled by a first switch, comprising a high voltage-drop energy dissipation path disposed across the first switch and a second switch by which a constant-voltage diode drop path across the load can be selectively opened.

11 Claims, 4 Drawing Sheets

FAST CURRENT CONTROL OF INDUCTIVE LOADS

CROSS REFERENCE TO RELATED APPLICATIONS

This application is a continuation of International Application No. PCT/GB01/04640 filed Oct. 17, 2001, which claimed priority to Great Britain Patent Application No. 0025832.7 filed Oct. 21, 2000, the disclosures of which are incorporated herein by reference.

BACKGROUND OF THE INVENTION

The present invention is concerned with the fast control of current in inductive electrical loads, such as solenoids, particularly but not exclusively in automotive electronic control systems.

Inductive loads, such as solenoid coils, are typically controlled by means of a switch, such as a switching transistor, connected in series with the load across a voltage supply. In automotive applications, one side of the load (referred to as the "low side") is normally connected to ground/chassis and the other side (referred to as the "high side") is coupled to the non-grounded side of the voltage supply. For the purpose of monitoring/measuring the current through the load, a sensing element such as a resister is placed in series with the load and the voltage drop across this resistor is measured.

Traditional technology often used current sensing near the load driving transistor, such that current monitoring was only available when the drive was turned on. When the level of the monitored current was to be used for control of the switching transistor, this arrangement therefore had poor control.

Some known arrangements have used high side control of the load using P channel MOSFET devices, but these are relatively expensive.

As is well known, the current in an inductive load decays with time when the voltage supply is removed and special circuitry must be provided to dispose of this current. The conventional practice is to achieve this by the provision of a recirculating diode disposed in parallel with the load which turns on automatically to provide a current path back to the supply. However, the rate at which a diode disposed across the load in this manner can dissipate the recirculating current is relatively poor and the current in the load therefore falls off only slowly (see curve X in FIG. 3 of the attached drawings).

Known means for achieving faster control of the current turn-off in inductive loads have typically used two MOSFET devices per channel, which has an attendant cost.

SUMMARY OF THE INVENTION

In accordance with the present invention, fast dissipation of the stored magnetic energy in an inductive load controlled by a first switch is enabled by the provision of a high-voltage-drop energy dissipation path across said first switch and a second switch by which a constant-voltage diode drop path across the load can be selectively opened.

In one preferred embodiment, said first switch comprises a switching transistor and said high-voltage drop energy dissipation path comprises a voltage regulating diode, such as a Zener diode, in parallel with the switching path of said switching transistor.

Advantageously, the switching transistor is a field-effect transistor such as a MOSFET, and the voltage regulating diode is connected between its source and drain terminals.

In another embodiment, the switching transistor is a field-effect transistor, such as a MOSFET, and the voltage regulating diode is connected, in series with a first diode, between its drain and gate terminals.

The second switch can, for example, comprise a MOSFET in series with a second diode across the series combination of the inductive load and a current sensing element.

In some particularly advantageous embodiments, said second switch commonly controls the opening of a plurality of said constant-voltage diode drop paths across a plurality of respective inductive loads, each of which is switchable by a respective first switch across which there is disposed a respective high-voltage-drop energy dissipation path.

A number of other advantageous features can be obtained using a circuit arrangement in accordance with the present invention;

(a) Phase locked current control. A small amount of ripple is allowed on the incoming demand signal, which causes the control loop to synchronise its control oscillation to that of an incoming PWM signal. This allows the external current control loop to have software controlled phase relationships between channels.

(b) Frequency locked current control. A small amount of ripple is allowed on the incoming demand signal, which causes the control loop to synchronise its control oscillation to that of the incoming PWM signal. This allows the external current control loop to have a software controlled oscillation frequency.

(c) Phase staggered control. The phase of individual current control channels is under the control of software. By software control, the control channels can be phase staggered. This results in the energise part of the control cycles being distributed evenly through time. The total current demand of the circuit is therefore more evenly distributed. The high frequency current demands of the circuit are reduced, and the frequency is raised. The reduction in peaks and the higher overall frequency allows for easier filtering and reduced electromagnetic emissions, without any additional hardware costs.

(d) Spread spectrum control. The frequency of the current control channels is under the control of software. By software control, the control channel frequencies can be changed dynamically over time. Electromagnetic emissions from the current control circuit are composed mainly of harmonics of the control frequency. By dynamically changing the frequency of control, all resulting emissions are modulated over a wider bandwidth. This reduces the peak energy of the emissions over a set measurement bandwidth, without any additional hardware costs.

Various objects and advantages of this invention will become apparent to those skilled in the art from the following detailed description of the preferred embodiment, when read in light of the accompanying drawings.

DETAILED DESCRIPTION OF THE INVENTION

Figure 3:
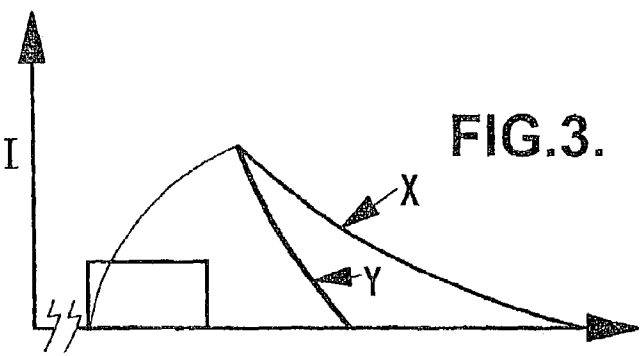
FIG. 3 shows typical responsive curves illustrating the dissipation of recirculating current in a known system and in a system in accordance with this invention.
Figure 1:
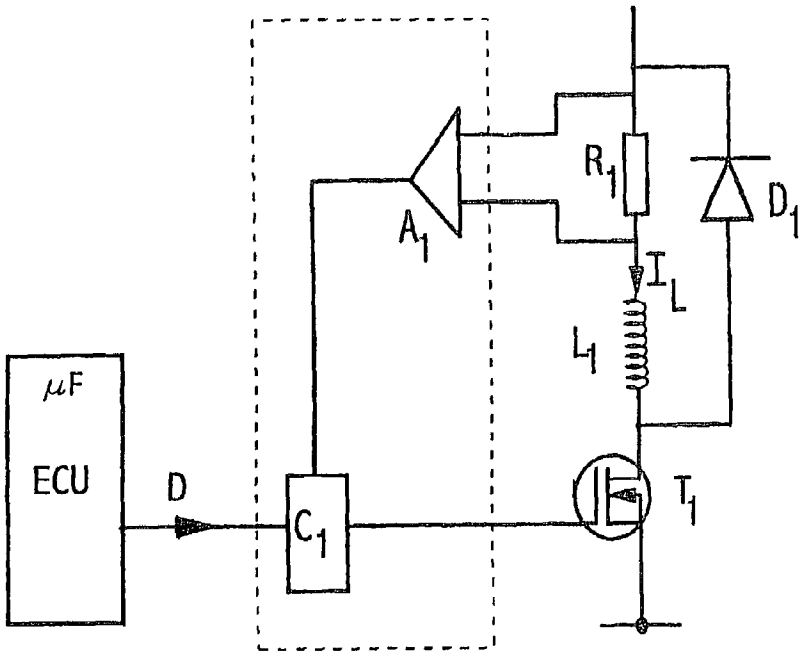
FIG.1. (PRIOR ART)
FIG. 1 is a basic circuit diagram of a known switching arrangement for controlling and monitoring the current through an inductive load.

Referring first to FIG. 1, there is shown the basic circuit of a typical known arrangement for controlling/monitoring the current $I_L$ through an inductive load $L_1$, such as the coil of a solenoid-operated valve. The current through the coil $L_1$, is switched on/off by a MOSFET $T_1$ driven by a controller $C_1$ in accordance with a demand signal D. The current $I_L$ is monitored by detecting the voltage drop across a resistor $R_1$, disposed in series with the coil $L_1$, using a differential amplifier $A_1$ coupled back to the controller $C_1$ to form an analogue control loop. A recirculation diode $D_1$ is connected in parallel with the series connection of the resistor $R_1$ and load $L_1$. In use of this circuit arrangement, when the MOSFET $T_1$ is turned off, the stored energy in the coil results in a current flow which is dissipated in the voltage drop across the recirculation diode $D_1$. However, as mentioned hereinbefore, the rate of dissipation of this current by the diode $D_1$ is relatively slow and typically follows a path such as that defined by curve X in FIG. 3

Figure 2:
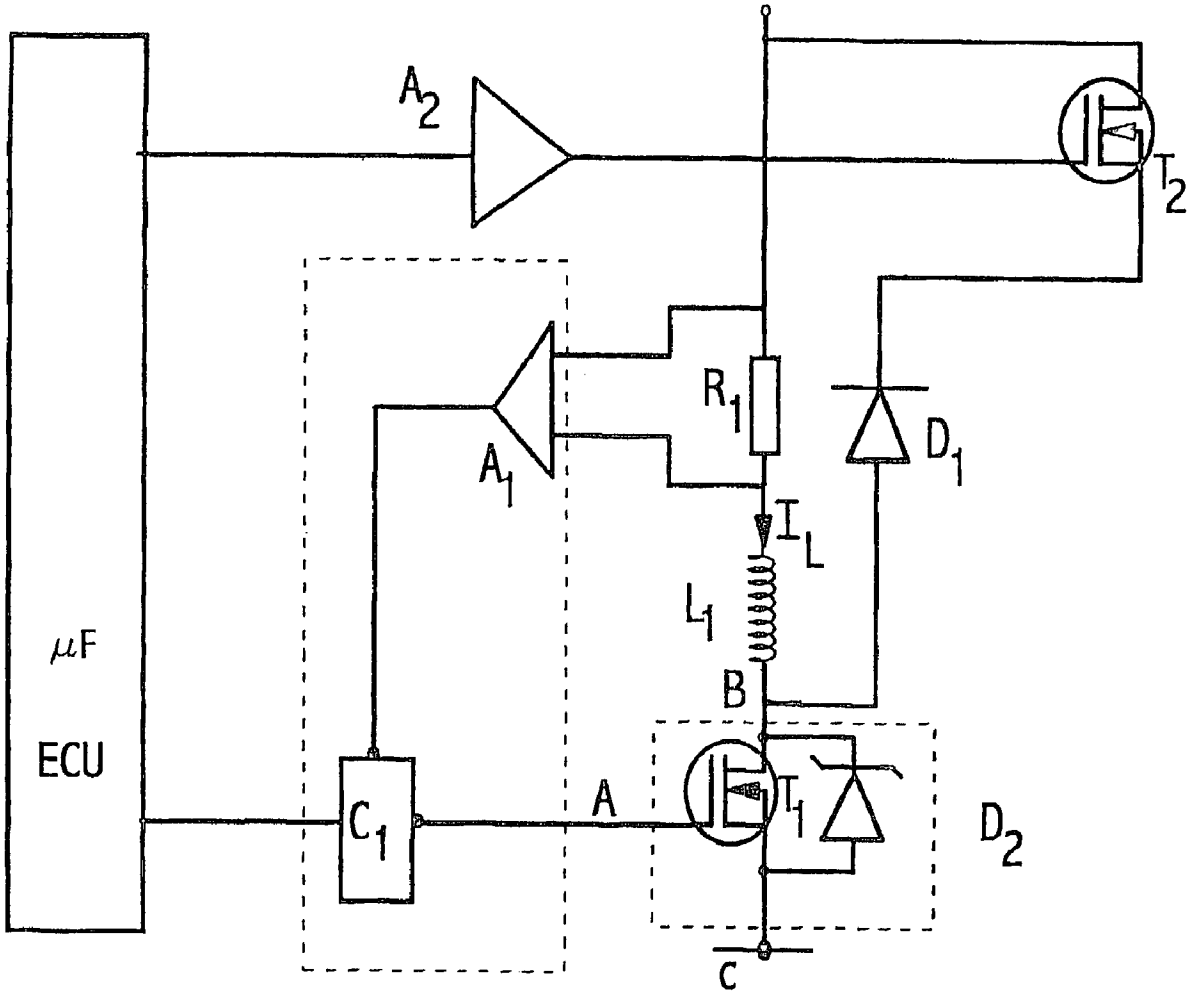
FIG. 2 is a basic circuit diagram of one embodiment of an arrangement in accordance with the present invention for controlling and monitoring the current through an inductive load.

Reference is now made to FIG. 2 which shows one embodiment of a circuit arrangement in connection with the present invention, wherein components having the same function are given the same reference numerals as in FIG. 1.

In this case, a MOSFET switching transistor $T_2$ is included in series with the recirculation diode $D_1$ to enable the conduction of the recirculation path through $D_1$ to be controlled by the ECU via a matching amplifier $A_2$. Thus, when the switch $T_2$ is closed, the diode $D_1$ provides a constant-voltage drop recirculation path in the normal way. However, when the switch $T_2$ is open-circuit, then the normal recirculation path is broken. This can be arranged to take place, for example, when it is detected via $R_1$ that the current $I_L$ on the load $L_1$ is too high (above a predetermined threshold). In this case, the recirculation currents which are de-energising the load $L_1$ are dissipated to ground by way of a high voltage drop energy dissipator, such as a Zener diode $D_2$ disposed across the MOSFET $T_1$. This allows the stored magnetic energy in the inductive load $L_1$ to be dissipated from the load at a much greater rate than using the constant voltage drop diode $D_1$ and a curve such as that shown at Y in FIG. 3 can be obtained.

Figure 4:
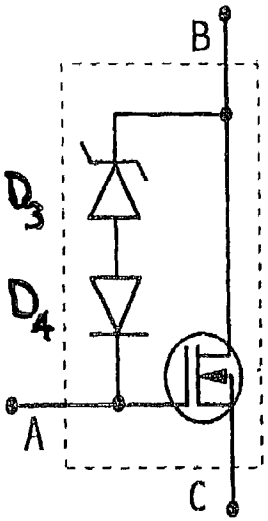
FIG. 4 is a circuit diagram of a possible modification to the circuit of FIG. 3.

FIG. 4 shows an alternative arrangement to the Zener diode $D_2$ of FIG. 2 where the series combination of a Zener diode $D_3$ and diode $D_4$ is disposed across the drain-gate terminals of the MOSFET $T_1$. A similar characteristic curve Y can be obtained by this arrangement.

Thus, the present circuit provides a means whereby, in the event of high induced currents in the switched load, the constant-voltage-drop diode $D_1$ can be replaced by the high-voltage-drop Zener arrangement $D_1$ by opening the switch $T_2$.

Figure 5:
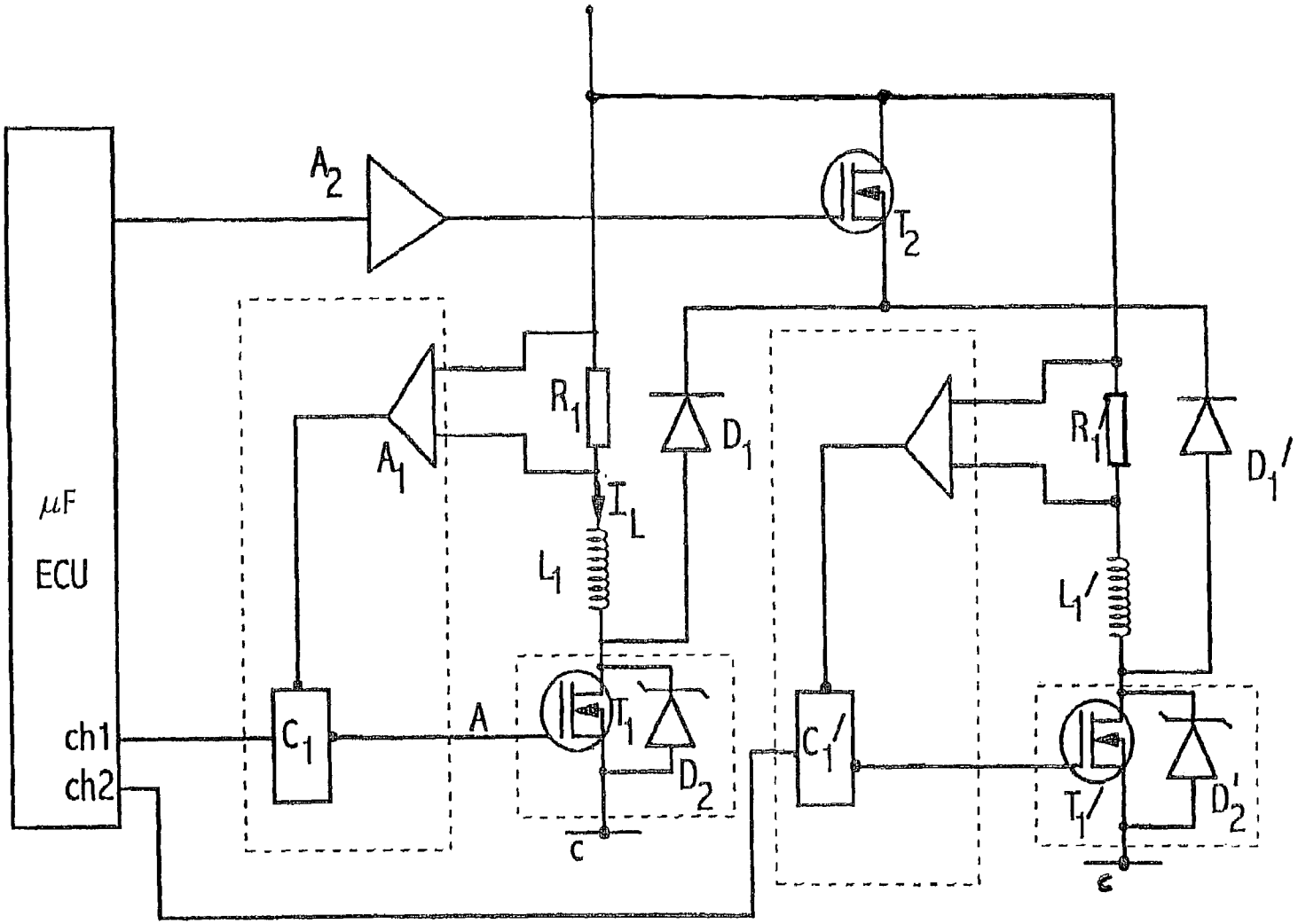
FIG. 5 is a basic circuit diagram of a multi-solenoid switching arrangement incorporating the present invention.

A particular advantage of this arrangement is that the same single recirculation switch $T_2$ can be used for a plurality of solenoid drives at once, for example as shown in FIG. 5. FIG. 5 shows a second load $L_1'$, which is switchable by means of a second MOSFET $T_1'$, with its current being monitored by a current sensor $R_1'$ and coupled by an analogue control loop to its own controller $C_1'$ which receives an input demand from the common ECU. It will be noted that both of the recirculation diodes $D_1$ and $D_1'$ in this circuit are coupled to the supply voltage $U_b$ by way of the same, single MOSFET switch $T_2$. This allows the advantageous arrangement of FIG. 2 to be added economically to existing load drives with one driver $T_1$ per channel plus just one stored switch $T_2$. This is possible because, from the viewpoint of channels which do not currently need the fast current decay, it does not matter if the recirculation path via $T_2$ is temporarily lost, for example by a 1 ms pulsed opening of $T_2$, to enable fast current decay via $D_2$ for a channel which does need it.

Figure 6:
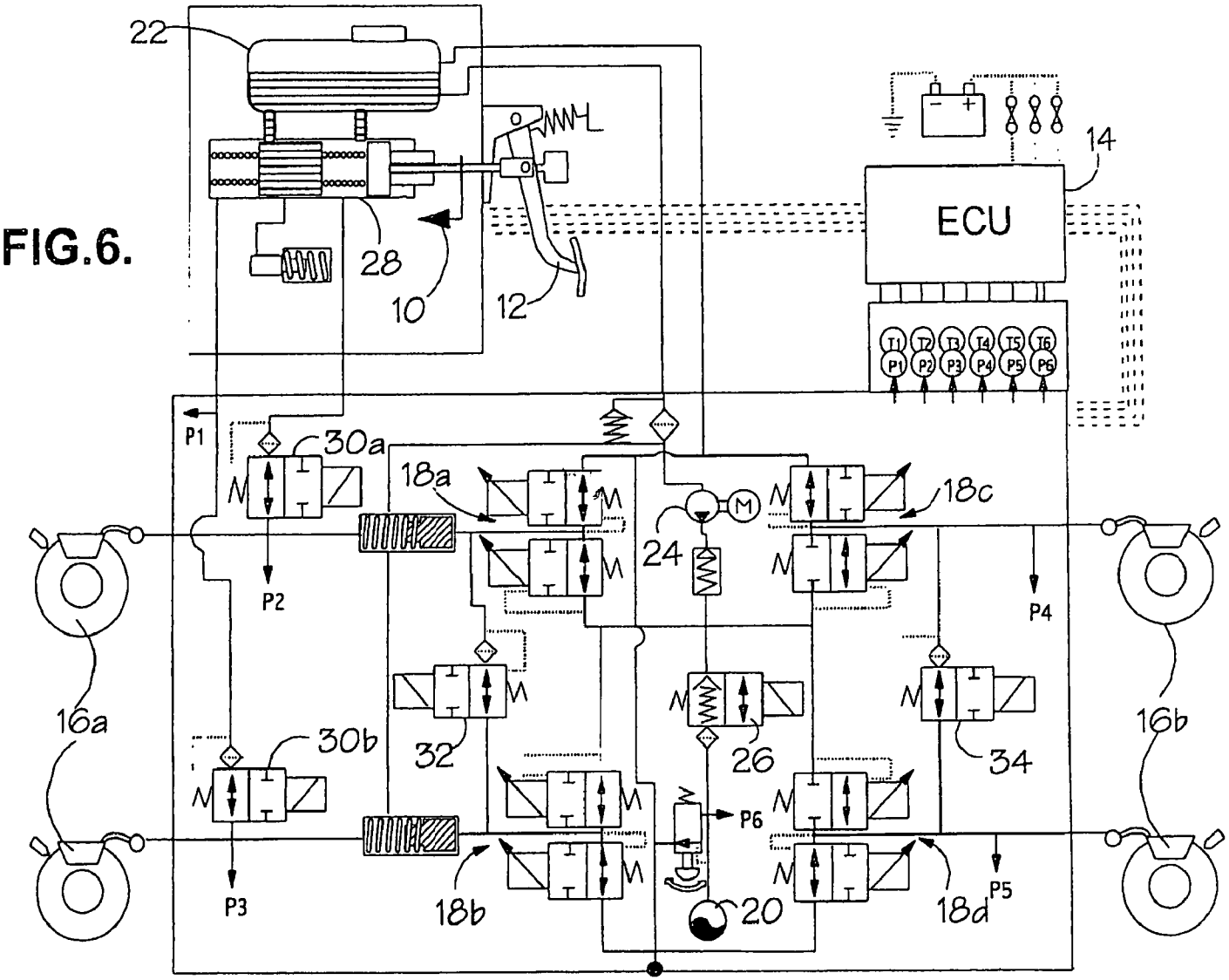
FIG. 6 shows an electro-hydraulic (EHB) braking system to which the present invention is applicable.

FIG. 6 shows a typical electrohydraulic (EHB) braking system to which the present invention is applicable. In the electrohydraulic braking system of FIG. 6, braking demand signals are generated electronically at a travel sensor 10 in response to operations of a foot pedal 12, the signals being processed in an electronic control unit (ECU) 14 for controlling the operation of brake actuators 16*a*, 16*b* at the front and back wheels respectively of a vehicle via pairs of valves 18*a*, 18*b* and 18*c*, 18*d*. The latter valves are operated in opposition to provide proportional control of actuating fluid to the brake actuators 16 from a pressurised fluid supply accumulator 20, maintained from a reservoir 22 by means of a motor-driven pump 24 via a solenoid controlled accumulator valve 26. For use, for example, in emergency conditions when the electronic control of the brake actuators is not operational for some reason, the system includes a master cylinder 28 coupled mechanically to the foot pedal 12 and by which fluid can be supplied directly to the front brake actuators 16*a* in a "push through" condition. In the push-through condition, a fluid connection between the front brake actuators 16*a* and the cylinder 28 is established by means of digitally operating, solenoid operated valves, 30*a*, 30*b*. Also included in the system are further digitally operating valves 32, 34 which respectively connect the two pairs of valves 18*a*, 18*b*, and the two pairs of valves 18*c*, 18*d*.

The system of the present invention for enabling fast switching can be applied to any of the solenoids in the arrangement of FIG. 6. Advantageously, where groups of solenoids are under the control of a single ECU such as in the case of the solenoid valves 18*a*-18*d*, 26, 32,34 and 30*a*, 30*b* in FIG. 6 (or sub-groups thereof), the arrangement of FIG. 5 can be advantageous where a single switched recirculation diode $T_2$ is common to all solenoids in the group or sub-group.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

The invention claimed is:

1. A circuit arrangement for the fast dissipation of the stored magnetic energy in an inductive load, the circuit arrangement comprising of:

an inductive load;

a constant-voltage-drop diode path across said inductive load, said constant-voltage-drop diode path including a first constant-voltage diode;

a first switch connected to said inductive load and operable to control same, said first switch being a field effect transistor having a drain terminal connected to said inductive load and a gate terminal;

a high-voltage-drop energy dissipation path also that includes a series combination of a voltage regulating diode and a second constant-voltage diode connected between said drain and gate terminals of said field effect transistor; and a second switch that is operable to selectively make and break said constant-voltage drop diode path, so that while said second switch is closed to make said constant-voltage-drop diode path, dissipation of the stored magnetic energy is able to take place due to current flow through said constant-voltage-drop diode path, and so that opening said second switch to break said constant-voltage-drop diode path, in response to excess current in the inductive load, enables current flow through the high-voltage-drop energy dissipation path and consequent fast dissipation of the stored magnetic energy.

2. A circuit arrangement as claimed in claim 1, wherein said field effect transistor is a first field effect transistor and further wherein said second switch is a second field effect transistor in series with said first constant-voltage diode and said second field effect transistor and said constant-voltage diode are connected across said inductive load.

3. A circuit arrangement for the fast dissipation of the stored magnetic energy in each of a plurality of inductive loads with each of the inductive loads controlled by a corresponding first switch, the circuit comprising:

a plurality of high-voltage-drop energy dissipation paths, with one of said high-voltage-drop energy dissipation paths disposed across each of the first switches;

a plurality of constant-voltage diode drop paths, with each of said constant-voltage diode drop paths connected across a corresponding one of the inductive loads; and a second switch commonly connected to said constant-voltage diode drop paths, said second switch selectively operative to control the opening of said constant-voltage diode drop paths to redirect current flowing through the constant-voltage diode drop paths to flow through the high-voltage drop energy dissipation paths whereby energy stored in the inductive loads is dissipated at a higher rate.

4. A circuit arrangement for the fast dissipation of the stored magnetic energy in each of a plurality of inductive loads with each of the inductive loads controlled by a corresponding first switch, the circuit comprising:

a plurality of high-voltage-drop energy dissipation paths, with one of said high-voltage-drop energy dissipation paths disposed across each of the first switches;

a plurality of constant-voltage diodes, with each of said constant-voltage diodes connected across a corresponding one of the inductive loads to provide a constant-voltage drop path across said corresponding inductive load; and a single field effect transistor commonly connected to said plurality of constant voltage diodes with said field effect transistor cooperating with each of said constant voltage diodes to form a series circuit across a corresponding series combination of one of the inductive loads and a current sensing element.

5. A circuit arrangement as claimed in claim 4 wherein each of said first switches comprise a switching transistor and each of said high-voltage drop energy dissipation paths includes a voltage regulating diode connected in parallel with the switching path of said switching transistor.

6. A circuit arrangement as claimed in claim 5 wherein each of said first switching transistors is a field effect transistor with said voltage regulating diode connected between the source and drain terminals of said field effect transistor.

7. A circuit arrangement as claimed in claim 6 wherein each of said voltage regulating diodes is a Zener diode.

8. A circuit arrangement as claimed in claim 5 wherein each of said first switching transistors is a field effect transistor and further wherein said voltage regulating diode is connected, in series with a second constant-voltage diode, between the drain and gate terminals of said field effect transistor.

9. A circuit arrangement as claimed in claim 8 wherein each of said voltage regulating diodes is a Zener diode.

10. A circuit arrangement for the fast dissipation of the stored magnetic energy in an inductive load, the circuit arrangement comprising:

an inductive load;

a current sensing element connected in a series combination with said inductive load;

a constant-voltage-drop diode path connected across said series combination of said inductive load and said current sensing element, said constant-voltage-drop diode path including a first constant-voltage diode;

a first switch connected to said inductive load and operable to control same, said first switch being a field effect transistor having a drain terminal connected to said inductive load and a gate terminal;

a high-voltage-drop energy dissipation path connected between said drain and gate terminals of said field effect transistor, said high-voltage dissipation path including a series combination of a voltage regulating diode and a second constant-voltage diode; and a second switch that is operable to selectively make and break said constant-voltage drop diode path, so that while said second switch is closed to make said constant-voltage-drop diode path, dissipation of the stored magnetic energy is able to take place due to current flow through said constant-voltage-drop diode path, and so that opening said second switch to break said constant-voltage-drop diode path, in response to excess current in the inductive load as sensed by said current sensing element, enables current flow through the high-voltage-drop energy dissipation path and consequent fast dissipation of the stored magnetic energy.

11. A circuit arrangement as claimed in claim 10, wherein said field effect transistor is a first field effect transistor and further wherein said second switch is a second field effect transistor connected in series with said first constant-voltage diode and further wherein said second field effect transistor and said first constant-voltage diode are connected across said series combination of said inductive load and said current sensing element.

* * * * *